US007237597B2

(12) United States Patent
Beitelman

(10) Patent No.: US 7,237,597 B2
(45) Date of Patent: Jul. 3, 2007

(54) METHOD AND DEVICE FOR CONTINUOUS CASTING OF METALS IN A MOLD

(75) Inventor: Leonid Beitelman, Thornhill (CA)

(73) Assignee: ABB Group Services Center AB, Västerås (SE)

( * ) Notice: Subject to any disclaimer, the term of this patent is extended or adjusted under 35 U.S.C. 154(b) by 0 days.

(21) Appl. No.: 11/230,535

(22) Filed: Sep. 21, 2005

(65) Prior Publication Data

US 2006/0191663 A1 Aug. 31, 2006

(51) Int. Cl.
*B22D 11/04* (2006.01)

(52) U.S. Cl. ..... 164/468; 164/504

(58) Field of Classification Search ..... 164/468, 164/504

See application file for complete search history.

(56) References Cited

U.S. PATENT DOCUMENTS 4,933,005 A 6/1990 Mulcahy et al.

5,699,850 A 12/1997 Beitelman et al.

FOREIGN PATENT DOCUMENTS

JP 3-76667 * 4/1991
WO 99/30856 6/1999

* cited by examiner

*Primary Examiner*—Len Tran
(74) *Attorney, Agent, or Firm*—Dykema Gossett PLLC

(57) ABSTRACT

A device for continuous or semi-continuous casting of metals, comprising a casting mold (1) which is open in both ends in the casting direction, means (2) for supplying melt to the mold (1), a first electromagnetic induction coil (4) energized by A.C. current and adapted to induce a stirring motion to the melt (7) in the mold (1), and a second electromagnetic induction coil (3) arranged upstream of the first induction coil (4) and adapted to control the stirring motion of the melt in the region adjacent to the upper free surface (5) of the melt. The second induction coil (3) is arranged to be interchangeably energized by either D.C. or A.C. current. The invention also relates to methods for control of stirring motion in a casting mold (1).

9 Claims, 4 Drawing Sheets

METHOD AND DEVICE FOR CONTINUOUS CASTING OF METALS IN A MOLD

FIELD OF INVENTION

The present invention relates to a method and a device for continuous or semi-continuous casting of metals and alloys, e.g. steel, in a casting mold which is open in both ends in the casting direction.

BACKGROUND OF INVENTION

Stirring of liquid steel in a continuous casting mold by means of an externally applied low-frequency A.C. electromagnetic field is a well-established practice in continuous casting steel operations. Electromagnetic stirring, commonly known as EMS, is broadly employed in continuous casting of steel in order to improve quality of the as cast product and process productivity. It was established that control of stirring motion in the region closely adjacent to the melt free surface, commonly termed meniscus, is required to meet the conditions of different casting practices. Thus a certain intensity stirring motion in the meniscus region is necessary in order to control surface and subsurface porosity, subsurface inclusions and other defects in billets and blooms produced from mainly Si—Mn deoxidized steel. The other casting practice, known as the submerged pouring under the mold powder, requires meniscus stability, and therefore it imposes restrictions to stirring motion at the meniscus. Besides these two opposing requirements stemmed from casting practices, the direct correlation was established between certain groups of strand defects and stirring intensity in both the meniscus region and the mold bulk. Therefore the need for control of stirring motion in those regions of the casting mold has necessitated a number of techniques based on application of D.C. or A.C. electromagnetic fields. Thus control of stirring motion in the meniscus region of the mold by means of a horizontal D.C. magnetic field was described in the U.S. Pat. No. 4,933,005. According to this patent, an externally applied D.C. magnetic field interacts with the stirring flow in the meniscus region originated by the main stirrer. An electromagnetic force results from this interaction and this force opposes liquid metal motion, thereby reducing the velocity of that motion. This method of stirring velocity control has limitations. Within the configuration common for the equipment used for continuous casting of billets and blooms, dimensions of the braking coil is restricted, as a result strength of D.C. magnetic field produced by the brake is sufficient only for reduction of stirring velocity at the meniscus up to 50 to 60 percent of the velocity original value.

Another known method in, prior art with the objective to control stirring motion in the meniscus region is a dual-coil EMS system operating with A.C. current and described in the U.S. Pat. No. 5,699,850. According to this patent, an induction coil arranged in the upper part of the mold in the meniscus region is energized from a current source independent from the current source of the main stirrer arranged in a lower portion of the mold. Thus a rotating A.C. magnetic field produced by the upper induction coil is independently controlled with respect to the magnetic field of the main stirrer. When the rotational direction of magnetic fields produced by the upper and the main stirrers coincides, stirring velocity in the meniscus region increases. This velocity increase can be controlled by the current input to the upper coil. In the case of rotational directions opposing each other, the upper stirrer becomes a magnetic brake with respect to the stirring flow in the meniscus region. By adjusting current of the brake, stirring velocity in the meniscus region can be controlled within a range from its original value when there is no braking action applied, to virtual zero, when magnetic torque of the brake is in balance with the angular momentum of stirring flow in the meniscus region.

As a downside of this method, the braking action has an effect only on the azimuthal component of the fluid flows induced by stirring or by the impact of pouring stream discharging into the mold. The longitudinal component of these flows remains unaffected by the A.C. magnetic field produced by the upper induction coil. These longitudinal fluid flows, depending on their intensity, produce a significant turbulence to the melt at the meniscus and in the region adjacent to the meniscus, therefore affecting operating conditions of casting practice and product quality.

SUMMARY OF THE INVENTION

The object of the present invention is to provide a more flexible control of stirring velocity and melt flow, i.e. liquid metal flow, in the meniscus region of the melt in a mold of continuous casters used for the production of e.g. billets and blooms.

The object of the invention is achieved by a device having the characteristics of claim 1, a method having the characteristics of claim 7 and a method having the characteristics of claim 11.

According to the present invention, the upper induction coil, here denominated "the second induction coil", of a dual-coil stirring system is energized either by D.C. or A.C. current depending on the desired effect on the stirring motion of the melt in the region adjacent to the upper free surface of the melt, whereas the main induction coil, here denominated "the first induction coil", is always operating as a stirrer energized A.C. current, i.e. producing an A.C. magnetic field.

The second induction coil is preferably energized by A.C. current from an independent source with respect to the main stirrer, i.e. with respect to the first induction coil. When the stirring system is used with the casting utilizing metering nozzle and there is a need to enhance the stirring motion in the meniscus region, the upper induction coil operates in the mode of assisting to the main stirrer. A.C. current is also used to energize the upper induction coil when a full or nearly full reduction of stirring velocity at the meniscus is required with the submerged pour casting practice.

A partial reduction of stirring velocity at the meniscus can be achieved by applying horizontal DC magnetic field. Such a partial braking action is required with the casting utilizing either metering nozzle or submerged entry nozzle and stirring velocity at the meniscus is needed to be controlled within a range of up to 60 or 50 percent of Its original value. In this case D.C. current is used in order to energize the upper induction coil. Experience has shown that such braking intensity is sufficient in many instances of the submerged pour casting practice and for the casting through metering nozzle. At high levels of stirring intensity, the further reduction of stirring velocity is achieved by applying an A.C. magnetic field. Switching current from A.C. to D.C. and vice versa is preferably accomplished by electronic and programming means, which constitutes a part of the system power supply. Fluid flows in the meniscus region arising from stirring produced by the main stirrer, discharging stream of liquid metal, and/or movement of the mold will interact with the horizontal D.C. magnetic field produced by the upper induction coil. As a result of the interaction between the horizontal D.C. magnetic field and the fluid flows crossing the magnetic field at any angle different from 0 degrees, magnetic forces will arise and impede motion of these flows. The maximum interaction is reached at a 90 degree angle between the magnetic field and fluid flow. As a result, velocity of stirring motion and longitudinal flows, including discharging straight down pouring stream, will be reduced. Turbulence in the meniscus will thus be reduced, resulting in improved meniscus stability, process operating conditions and cast product quality.

Thus considering interchangeability of A.C. and D.C. magnetic fields which are provided by a single stirring system and produced by the same induction coil arranged in the meniscus region of a casting mold, this invention brings significant improvements in flexibility of controlling stirring velocity and turbulence at the meniscus and results in an increased effectiveness of metallurgical performance and efficiency of the stirring system.

The invention is a further improvement of the method and the apparatus of dual-coil stirring system. This invention is broadly applicable to all electroconductive materials, i.e. metals and alloys, which can be stirred electromagnetically and where control of stirring motion is required within some region or regions with minimal if any at interference with stirring motion of other regions of the liquid metal columns. The invention is applicable to a wide variety of special orientations of casting mold. The mold can be arranged vertically, horizontally or inclined.

BRIEF DESCRIPTION OF THE DRAWINGS

The present invention will now be explained in more detail with reference to different embodiments, disclosed by way of example only, and with reference to the figures attached.

DETAILED DESCRIPTION OF PREFERRED EMBODIMENTS OF THE INVENTION

Figure 1:
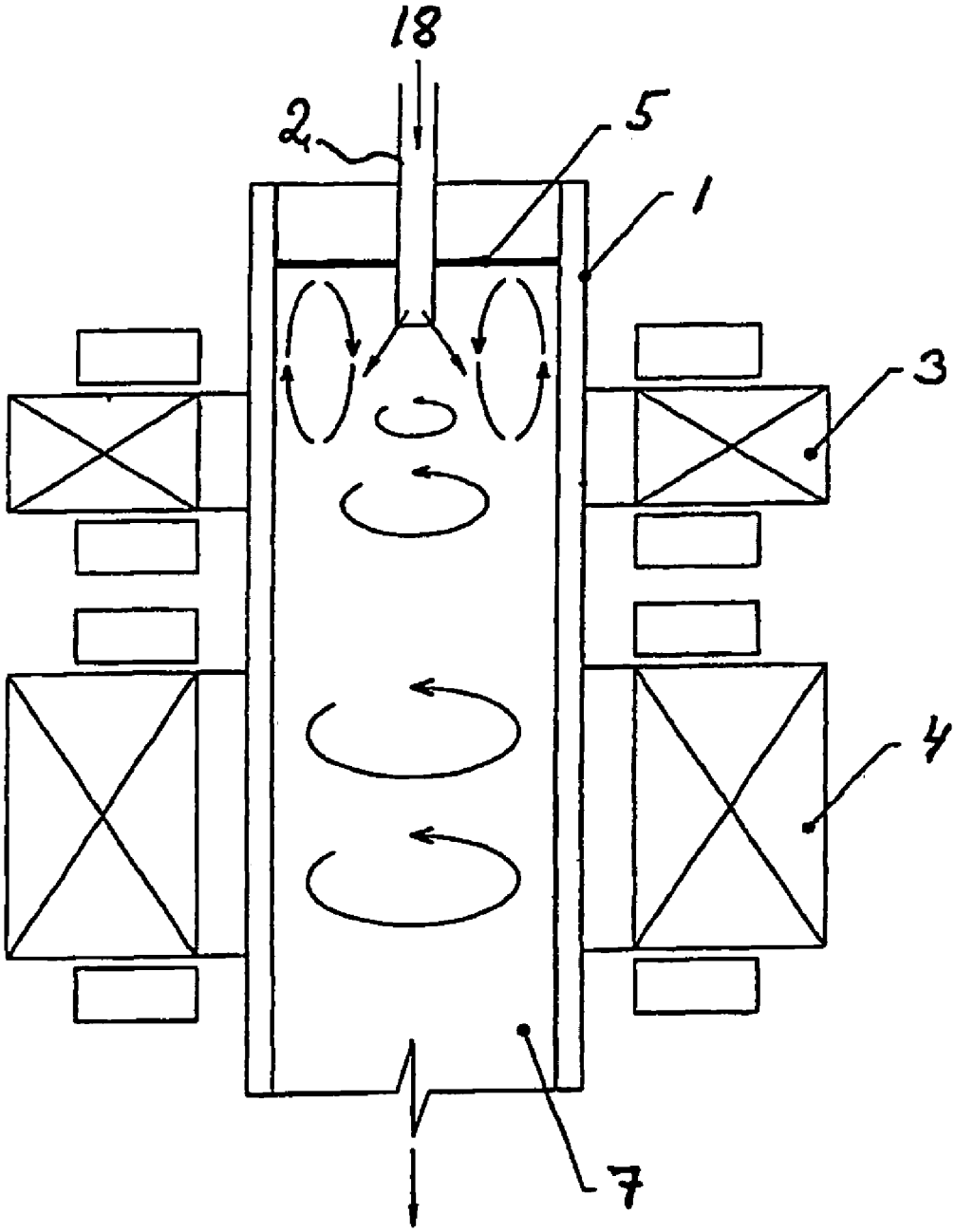
FIG. 1 discloses schematically a dual-coil stirring system with respect to a casting mold in accordance with one embodiment of the invention.

FIG. 1 discloses a device for continuous or semi-continuous casting of metals according to an embodiment of the invention. The device comprises a casting mold 1, which is open in both ends in the casting direction, and means 2 for supplying hot melt 7 to the mold. The device is provided with a dual-coil electromagnetic stirring (EMS) system, comprising a first induction coil 4 and a second induction coil 3. The second induction coil 3 is arranged at the top end of the mold, upstream of the first induction coil 4. Consequently, the first induction coil 4 is arranged downstream of the second induction coil 3. The first induction coil 4 is operating as a stirrer and is energized by A.C. current producing an A.C. magnetic field. The first induction coil 4 constitutes an A.C. electromagnetic stirrer and is designed, when energized, to induce a rotary motion about the longitudinal axle of the mold 1 to the molten metal 7 within the mold 1. In FIG. 1 the melt is supplied to the mold by means of a casting tube 2 which opens out below the upper surface of the melt, the meniscus 5. It is of course also possible to utilize other types of means for supplying melt to the mold 1.

According to the invention, the second induction coil 3 is interchangeably energized by either D.C. or A.C. current depending on the desired effect on the stirring motion of the melt in the region adjacent to the upper free surface 5 of the melt. In order to control the type of current supplied to the second induction coil 3, the device is preferrably provided with means 12, schematically indicated in FIG. 2, for switching the current to the second induction coil 3 from A.C. to D.C. and vice versa. Switching current from A.C. to D.C. and vice versa is preferably accomplished by electronic and programming means 12, which constitute a part of the system power supply.

Figure 2:
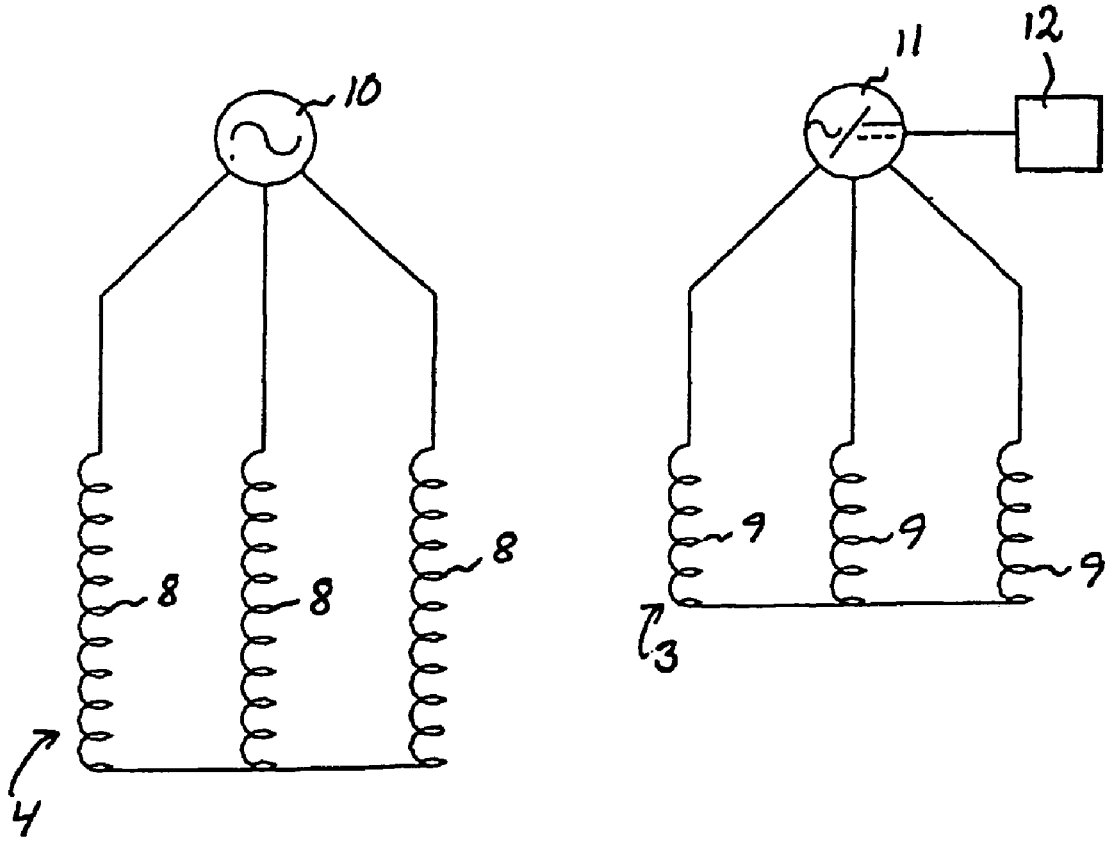
FIG. 2 is a single-line diagram of possible electrical connections for the induction coils of a device according to an embodiment of the invention.

The second induction coil 3 is preferably energized by A.C. current from an independent source with respect to the first induction coil 4. According to a preferred embodiment of the invention, a first power source 10 is provided for supplying A.C. current to the first induction coil 4, and a second power source 11 is provided for interchangeably supplying A.C. and D.C. current to the second induction coil 3. Said first and second power sources are schematically indicated in FIG. 2. The means for switching current from A.C. to D.C. and vice versa are schematically indicated at 12 in FIG. 2. Consequently, either A.C. or D.C. current can be selected to energize the second coil 3. This arrangement allows for independent control of stirring actions of either of the first or the second induction coils regardless of directional pattern of stirring produced by the first induction coil 4.

According to a preferred embodiment of the invention, the first induction coil 4 comprises a series of coils 8 arranged around the periphery of the casting mold 1. These coils 8 are preferably of multi-phase and multi-pole arrangement. It is also preferred that the second induction coil 3 comprises a series of coils 9 arranged around the periphery of the casting mold 1. These coils 9 are preferably also of multi-phase and multi-pole arrangement.

According to an aspect of the invention, the second induction coil 3 is capable of providing at least three different modes of operation, namely

- a first mode in which the second induction coil 3 is energized by A.C. current and the rotational direction of the magnetic field produced by the second induction coil 3 coincides with the rotational direction of the magnetic field produced by the first induction coil 4, the magnetic field produced by the second induction coil 3 thereby enhancing the velocity of the stirring motion induced in the region of the melt adjacent to the upper free surface 5 of the melt by the first induction coil 4, the stirring velocity of the melt in said region being controlled by adjusting the value of the A.C. current supplied to the second induction coil 3,
- a second mode in which the second induction coil 3 is energized by A.C. current and the rotational direction of the magnetic field produced by the second induction coil 3 opposes the rotational direction of the magnetic field produced by the first induction coil 4, the magnetic field produced by the second induction coil 3 thereby reducing the velocity of the stirring motion induced in the region of the melt adjacent to the upper free surface 5 of the melt by the first induction coil 4, the stirring velocity of the melt in said region being controlled by adjusting the value of the A.C. current supplied to the second induction coil 3, and a third mode in which the second induction coil 3 is energized by D.C. current so as to produce a horizontally directed D.C. magnetic field, which induces electromagnetic forces in the melt 7 opposing the direction of fluid flows, in transversal as well as longitudinal spatial planes of the mold 1, in the region of the melt adjacent to the upper free surface 5 of the melt, the magnetic field produced by the second induction coil 3 thereby reducing the velocity of the stirring motion induced in the region of the melt adjacent to the upper free surface 5 of the melt by the first induction coil 4, the velocity of longitudinal flows produced in the melt 7 by the stirring action of the first induction coil 4 as well as longitudinal flows produced by continuously discharging melt into the mold 1.

The desired mode of operation is selected among the above-mentioned modes depending upon the casting process employed. The desired effect of the second induction coil 3 on the stirring motion of the melt in the region adjacent to the meniscus 5 varies with the type of casting process employed.

According to the invention, the second induction coil 3 is energized either by D.C. or A.C. current in order to produce a braking action in the mold meniscus region for improvement of stirring motion control. Also, a metallurgical effectiveness of the EMS system is achieved. Braking action performed with A.C. magnetic field may control stirring velocity at the meniscus within a wide range including virtual zero velocity. The negative impact produced by the braking on stirring motion in the mold bulk is such that stirring velocity in this region can be reduced by as much as 20 percent. Providing the braking action by a horizontal D.C. magnetic field can control stirring velocity in the meniscus region within the range of up to 50 percent of the velocity original value without affecting stirring motion in the mold bulk. This is sufficient for most of the requirements of the continuous casting steel practice with submerged pouring.

The braking action originated from the interaction between a horizontal D.C. magnetic field produced by the second induction coil 3 and rotating stirring flow in the meniscus region is mostly confined within the boundaries between the meniscus and the bottom end of the magnetic brake. The stirring motion within the mold bulk produced by the main stirrer, i.e. the first induction coil 4, remains practically unaffected by the braking action in the meniscus region produced by a horizontal D.C. magnetic field.

The intensity of the rotational flow in the melt 7 is characterized by its rotational (angular) velocity U which, in turn, depends on the parameters of the magnetic torque and its spatial distribution within the melt, and the size and geometry of the mold cross-section. For a relatively small axisymmetrical geometry system, e.g. cylindrical or square cross-section, the magnetic torque can be defined in accordance with the following expression:

$$T=0.5\pi f\sigma B^2R^4L$$

where:

T is the magnetic torque produced by a 2-phase or 3-phase A.C. magnetic field, f is the current frequency, σ is the liquid metal electrical conductivity, B is the magnetic flux density, R is the stirring pool radius, and L is the length of stirrer iron yoke.

The independent control of stirring motion at the meniscus 5 provided by the interchangeable use of A.C. or D.C. current for energizing the second induction coil 3 enables a greater flexibility and accuracy of the stirring process control as well as control of turbulence in the meniscus region caused by longitudinal fluid flows introduced by the first induction coil 4, pouring stream, indicated at 18 in FIG. 1, and oscillating motion of the mold 1.

Reduction of fluid flow motion in both transversal and longitudinal planes by the D.C. brake, i.e. the second induction coil 4 when energized by D.C. current, occurs due to arising electromagnetic force, i.e. the Lorentz force, as a result of the interaction between D.C. magnetic field and moving electroconductive fluid flow in accordance with the following expressions:

$$F=B\times J$$

$$J=\sigma(E+U\,B)$$

where:

J is the induced current density within the melt,

U is the velocity of the melt flow, and

E is the electric potential.

Figure 3:
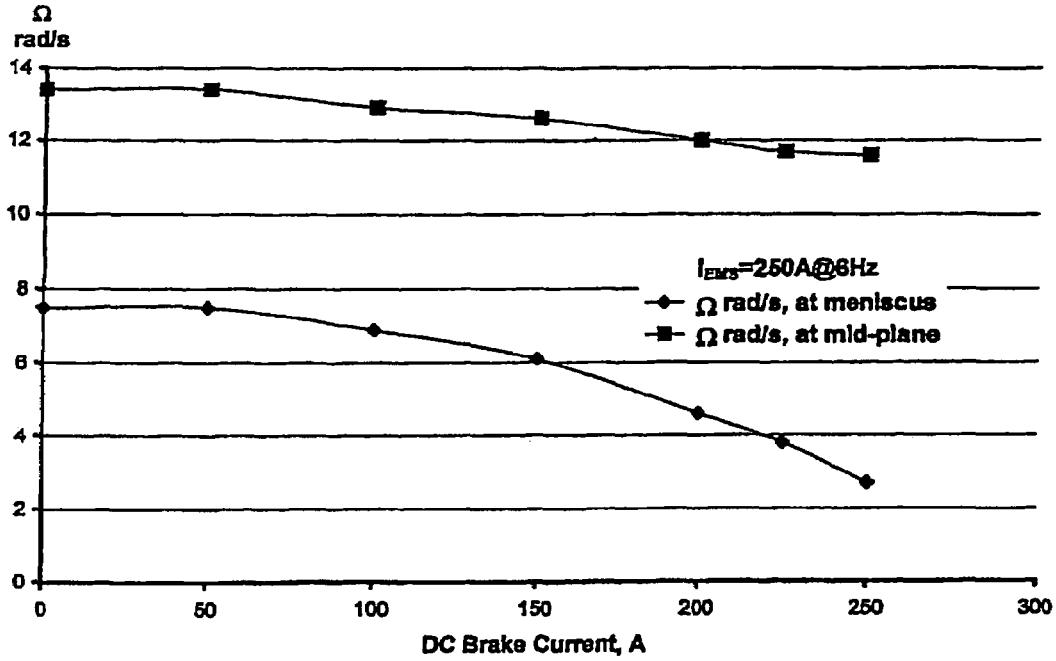
FIG. 3 is a graphical representation of the relationship between current of a DC magnetic brake and stirring velocity at the meniscus and in the mid-plane of an electromagnetic stirrer in a column of mercury.

As electromagnetic force F depends on the magnitude of both magnetic flux density B and fluid flow velocity U, it is apparent that a significant increase of current is required in order to reduce fluid flow velocity to the near zero level. In many situations of the continuous casting practice such velocity reduction is not necessary. As shown in FIG. 3, stirring velocity at the meniscus of a pool of mercury was reduced from the original 7.3 rad/s to 2.7 rad/s at the D.C. current input of 250 A. Linear extrapolation of velocity reduction suggests that 335 A is required to reduce stirring velocity for a virtual zero level.

Figure 4:
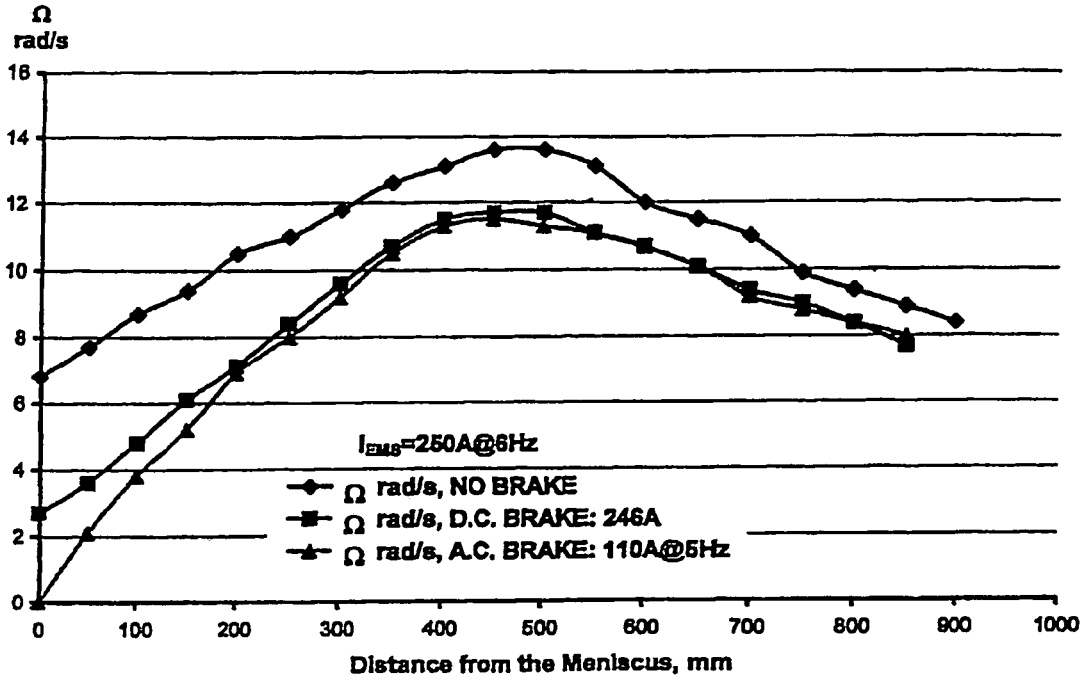
FIG. 4 is a graphic representation of the axial profiles of measured stirring velocity in a mercury pool of square cross section for a dual-coil EMS system operating with and without an A.C. and D.C. magnetic field brake.

Stirring velocity reduction in the meniscus region by means of D.C. brake exerts also a breaking impact on stirring velocity at the mid-plane of the main EMS, i.e. the first induction coil 4, similar to the effect produced by the A.C. brake. FIGS. 3 and 4 show that stirring velocity at the mid-plane of the EMS was approximately 11.7 rad/s or 86% of the original value of 13.6 rad/s when stirring velocity at the meniscus was reduced by the D.C. brake to 2.7 rad/s.

The present invention provides an improved method of controlling liquid metal motion in both horizontal and longitudinal directions within the mold meniscus region. The longitudinal component of liquid metal motion induced by the main EMS and by other means, such as the pouring stream of liquid metal discharging into the mold will be minimized by employing induction coils in the form of the stirrer modifier, i.e. the second induction coil, arranged around the melt meniscus region and energized by D.C. electric current, whereas more complete control of stirring velocity, i.e. its azimuthal component, is achieved by using A.C. magnetic field produced by the stirrer modifier.

The expression "induction coil", as used in this description and the appended claims, also embraces an induction coil comprising several individual coils, as illustrated in FIG. 2.

The invention is of course not in any way restricted to the preferred embodiments described above, but many possibilities to modifications thereof will be apparent to a man with ordinary skill in the art without departing from the basic idea of the invention such as defined in the appended claims.

The invention claimed is:

1. A method for control of stirring motion in a casting mold for continuous or semi-continuous casting of metals, which mold is open in both ends in a casting direction, melt being supplied to the mold, a stirring motion being induced to the melt in the mold by means of a first electromagnetic induction coil energized by A.C. current, the stirring motion of the melt in a region adjacent to an upper free surface of the melt being controlled by means of a second electromagnetic induction coil arranged upstream of the first induction coil, wherein the second induction coil is selectively energized by either D.C. or A.C. current in accordance with requirements of casting operations; and including providing a mode of operation in which the second induction coil is energized by D.C. current so as to produce a horizontally-directed D.C. magnetic field which induces electromagnetic forces in the melt opposing fluid flow direction, in transversal as well as longitudinal spatial planes of the mold, in the region of the melt adjacent to the upper free surface thereof the magnetic field produced by the second induction coil thereby reducing a velocity of the stirring motion induced in the region of the melt adjacent to the upper free surface thereof by the first induction coil, a velocity of longitudinal flows produced in the melt by the stirring action of the first induction coil, as well as longitudinal flows produced by continuously discharging melt into the mold.

2. A method according to claim 1, wherein the current to the second induction coil is switched from A.C. to D.C. and vice versa by switching means.

3. A method according to claim 1 wherein the first induction coil is supplied with A.C. current from a first power source, and the second induction coil is selectively supplied with A.C. or D.C. current from a second power source.

4. A method according to claim 3, wherein the second power source is converted from an A.C. current source into a D.C. current source and vice versa by electronic and programming means.

5. A method for control of stirring motion in a casting mold for continuous or semi-continuous casting of metals, which mold is open in both ends in a casting direction, melt being supplied to the mold, a stirring motion being induced to the melt in the mold by means of a first electromagnetic induction coil energized by A.C. current, the stirring motion of the melt in the region adjacent to an upper free surface of the melt being controlled by means of a second electromagnetic induction coil arranged upstream of the first induction coil, wherein the second induction coil being selectively energized by an AC current or a DC current for providing three different modes of operation, including:

a first mode in which the second induction coil is energized by A.C. current and a rotational direction of a magnetic field produced by the second induction coil coincides with a rotational direction of a magnetic field produced by the first induction coil, the magnetic field produced by the second induction coil thereby enhancing a velocity of the stirring motion induced in the region of the melt adjacent to the upper free surface thereof by the first induction coil, the stirring velocity of the melt in said region being controlled by adjusting the value of the A.C. current supplied to the second induction coil, a second mode in which the second induction coil is energized by A.C. current and the rotational direction of the magnetic field produced by the second induction coil opposes the rotational direction of the magnetic field produced by the first induction coil, the magnetic field produced by the second induction coil thereby reducing the velocity of the stirring motion induced in the region of the melt adjacent to the upper free surface of the melt by the first induction coil, the stirring velocity of the melt in said region being controlled by adjusting the value of the A.C. current supplied to the second induction coil, and a third mode in which the second induction coil is energized by D.C. current so as to produce a horizontally-directed D.C. magnetic field which induces electromagnetic forces in the melt opposing the direction of fluid flows, in transversal as well as longitudinal spatial planes of the mold, in the region of the melt adjacent to the upper free surface of the melt, the magnetic field produced by the second induction coil thereby reducing the velocity of the stirring motion induced in the region of the melt adjacent to the upper free surface of the melt by the first induction coil, the velocity of longitudinal flows produced in the melt by the stirring action of the first induction coil as well as longitudinal flows produced by continuously discharging melt into the mold, the mode of operation being selected depending upon the casting process employed.

6. A method according to claim 5, wherein the first induction coil is supplied with A.C. current from a first power source, and the second induction coil is selectively supplied with A.C. or D.C. current from a second power source.

7. A method according to claim 6, wherein the second power source is converted from an A.C. current source into a D.C. current source and vice versa by electronic and programming means.

8. A method according to claim 1 for providing different modes of operation, including a first mode in which the second induction coil is energized by A.C. current and the rotational direction of the magnetic field produced by the second induction coil coincides with the rotational direction of the magnetic field produced by the first induction coil, the magnetic field produced by the second induction coil thereby enhancing the velocity of the stirring motion induced in the region of the melt adjacent to the upper free surface of the melt by the first induction coil, the stirring velocity of the melt in said region being controlled by adjusting the value of the A.C. current supplied to the second induction coil.

9. A method according to claim 1 for providing different modes of operation, including a second mode in which the second induction coil is energized by the second A.C. current and the rotational direction of the magnetic field produced by the second induction coil opposes the rotational direction of the magnetic field produced by the first induction coil, the magnetic field produced by the second induction coil thereby reducing the velocity of the stirring motion induced in the region of the melt adjacent to the upper free surface of the melt by the first induction coil, the stirring velocity of the melt in said region being controlled by adjusting the value of the A.C. current supplied to the second induction coil.

* * * * *